US006220682B1

(12) United States Patent
Vertullo

(10) Patent No.: US 6,220,682 B1
(45) Date of Patent: Apr. 24, 2001

(54) REFRIGERATOR SHELVING SYSTEM

(76) Inventor: Nicholas L. Vertullo, 34 Smith Hill Rd., Monsey, NY (US) 10952

( * ) Notice: Subject to any disclaimer, the term of this patent is extended or adjusted under 35 U.S.C. 154(b) by 0 days.

(21) Appl. No.: 09/545,083

(22) Filed: Apr. 7, 2000

(51) Int. Cl.[7] ..... A47B 88/00
(52) U.S. Cl. ..... 312/334.28; 312/404; 312/334.24
(58) Field of Search ..... 312/402, 401, 312/404, 330.1, 334.23, 334.24, 334.25, 334.26, 334.27, 334.28, 334.32

(56) References Cited

U.S. PATENT DOCUMENTS

| | | | | |
|---|---|---|---|---|
| 1,209,080 | * | 12/1916 | Tower | 312/301 |
| 1,748,843 | | 2/1930 | Kuckel . | |
| 1,750,291 | * | 3/1930 | Whetstone | 312/334.26 |
| 1,861,123 | | 5/1932 | Kuckel . | |
| 1,954,384 | * | 4/1934 | Hurt | 312/334.24 |
| 1,964,831 | | 7/1934 | Rein . | |
| 2,040,634 | * | 5/1936 | Sekyra | 312/334.25 |
| 2,161,912 | | 6/1939 | Cossin . | |
| 2,472,593 | | 6/1949 | King . | |
| 2,490,494 | * | 12/1949 | Widman | 312/301 |
| 2,719,772 | | 10/1955 | Petkwitz . | |
| 2,724,630 | | 11/1955 | Saunders . | |
| 2,826,475 | * | 3/1958 | Larson | 312/330.1 |
| 2,923,584 | * | 2/1960 | Broderick, Jr. | 312/334.25 |
| 3,301,618 | * | 1/1967 | Feldser et al. | 312/404 |
| 4,138,175 | | 2/1979 | Tattershall . | |
| 5,642,924 | | 7/1997 | Wohlrab et al. . | |

* cited by examiner

*Primary Examiner*—Peter M. Cuomo
*Assistant Examiner*—Jerry A. Anderson
(74) *Attorney, Agent, or Firm*—Arthur Jacob

(57) ABSTRACT

A shelving system for a refrigerator includes a plurality of shelf units having opposite sides and placed side-by-side within the interior of the refrigerator and mounted for selective movement along longitudinal directions between a retracted position, wherein the shelf units are located fully within the interior of the refrigerator, and an extended position, wherein the shelf units are placed outside the interior of the refrigerator. Each shelf unit includes a plurality of shelves extending lengthwise in the longitudinal direction, having a relatively narrow width in lateral directions, and spaced altitudinally from one another. In the extended position of each shelf unit, the shelves of the extended shelf unit are exposed for access in a lateral direction through one side of the shelf unit and the stored items are viewable from all sides. In the retracted position, the shelf units essentially fill the interior of the refrigerator.

10 Claims, 4 Drawing Sheets

REFRIGERATOR SHELVING SYSTEM

The present invention relates generally to refrigerators employed primarily as home appliances and pertains, more specifically, to a shelving system providing increased ease of access to items stored in such refrigerators.

Despite the many years since the refrigerator has become universally accepted as an essential kitchen appliance, little change has been made in the manner in which items are stored within a refrigerator. In particular, refrigerator shelving arrangements continue to be offered in various conventional configurations wherein the shelves span the width of the interior of the refrigerator, rendering access to the rear areas of the shelves at best inconvenient and, at worst, quite difficult. Consequently, it is not unusual for items stored toward the rear of a refrigerator to linger there, long past the expiration of freshness and usefulness.

The present invention provides a refrigerator shelving system which essentially eliminates hard-to-reach areas located toward the rear of the interior of a refrigerator, enabling easy access to the entire volume of the interior of the refrigerator for effective storage and retrieval of a wide variety of items. As such, the present invention attains several objects and advantages, some of which are summarized as follows: Provides a refrigerator shelving system which enables increased ease of access to items stored throughout the entire interior of a refrigerator; essentially eliminates ordinarily hard-to-reach areas located at the rear of a refrigerator interior; makes effective storage use of the full volume of a refrigerator interior; increases the availability of readily usable storage space within the interior of a refrigerator; allows increased ease in locating and accessing items stored in a refrigerator; provides a refrigerator shelving system having increased effectiveness in storage and use, with a relatively simple and economically fabricated construction; provides an easily modified arrangement which enables increased versatility for the storage of a wide variety of items in a refrigerator; avoids excessive residence time of stored items, and consequent spoilage, by affording ease of access to items stored at virtually any location within a refrigerator; provides an ergonomic arrangement which encourages effective utilization of available storage capacity of a refrigerator; enables increased ease in viewing and identifying items stored throughout the interior of a refrigerator; provides a shelving system compatible with conventional refrigerator construction for ease of incorporation into currently available refrigerator configurations; provides a relatively rugged construction capable of effective operation over a long service life.

The above objects and advantages, as well as further objects and advantages, are attained by the present invention which may be described briefly as a shelving system for a refrigerator having a cooled interior bounded by a top wall, an altitudinally opposite bottom wall, laterally opposite side walls, a rear wall and a longitudinally opposite front opening, the shelving system comprising: a plurality of shelf units, each shelf unit including laterally opposite sides aligned generally with the laterally opposite side walls of the interior of the refrigerator and shelves, each shelf having a longitudinal length and a lateral width, the shelves being arranged in an array of altitudinally spaced apart shelves with access to each shelf available through at least one side of a corresponding shelf unit, in lateral directions; and at least one suspension assembly mounting each shelf unit within the interior of the refrigerator for selective movement along longitudinal forward and backward directions between a retracted position, wherein the shelf unit is located fully within the interior of the refrigerator, between the front opening and the rear wall, and an extended position, wherein the shelf unit is extended longitudinally forward to expose the shelves for simultaneous access to all of the shelves of the shelf unit in lateral directions through at least one of the opposite sides of the shelf unit.

The invention will be understood more fully, while still further objects and advantages will become apparent, in the following detailed description of a preferred embodiment of the invention illustrated in the accompanying drawing, in which.

Figure 1:
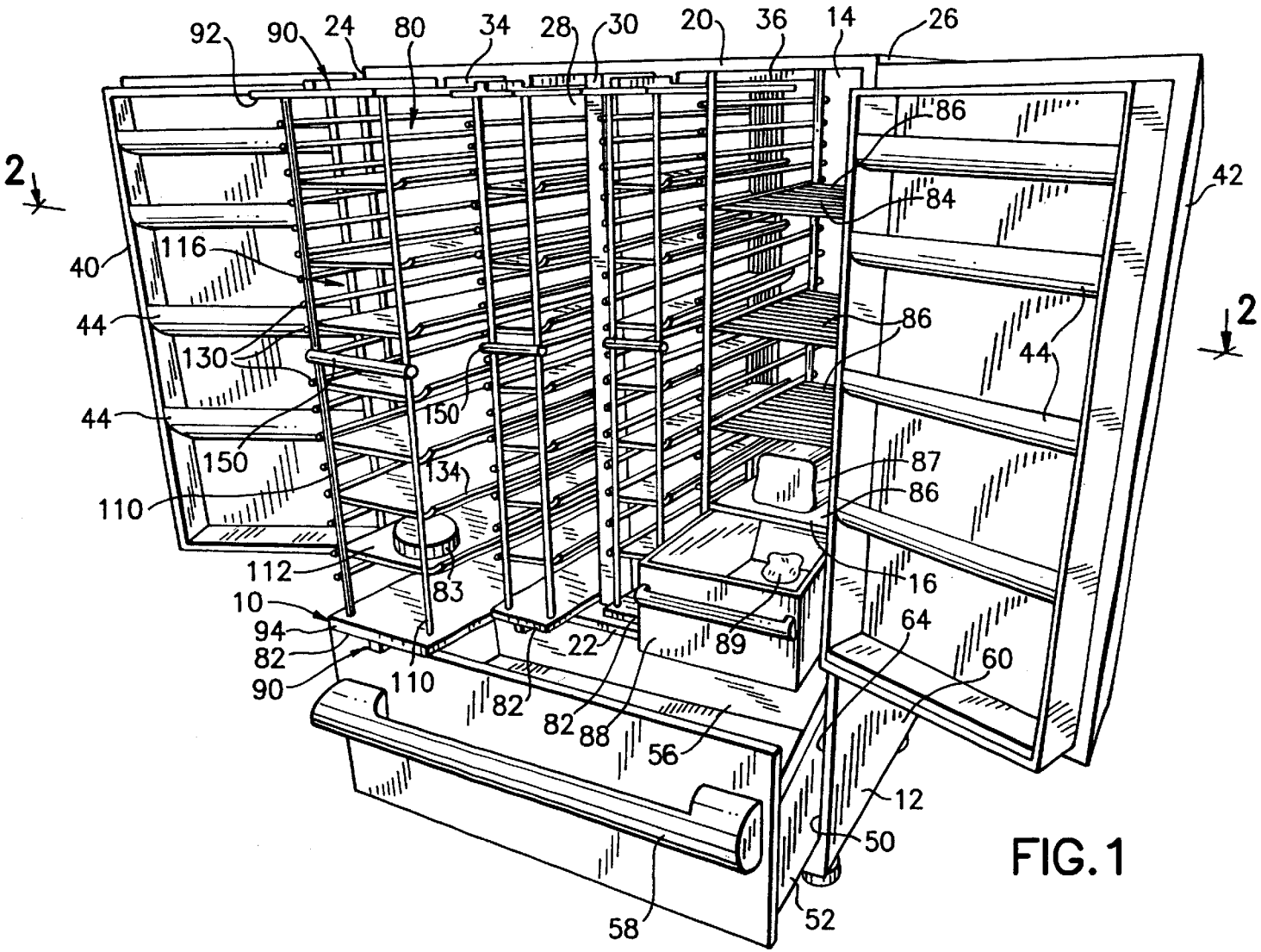
FIG. 1 is a pictorial front and right side perspective view of a refrigerator opened to reveal a shelving system constructed in accordance with the present invention.
Figure 2:
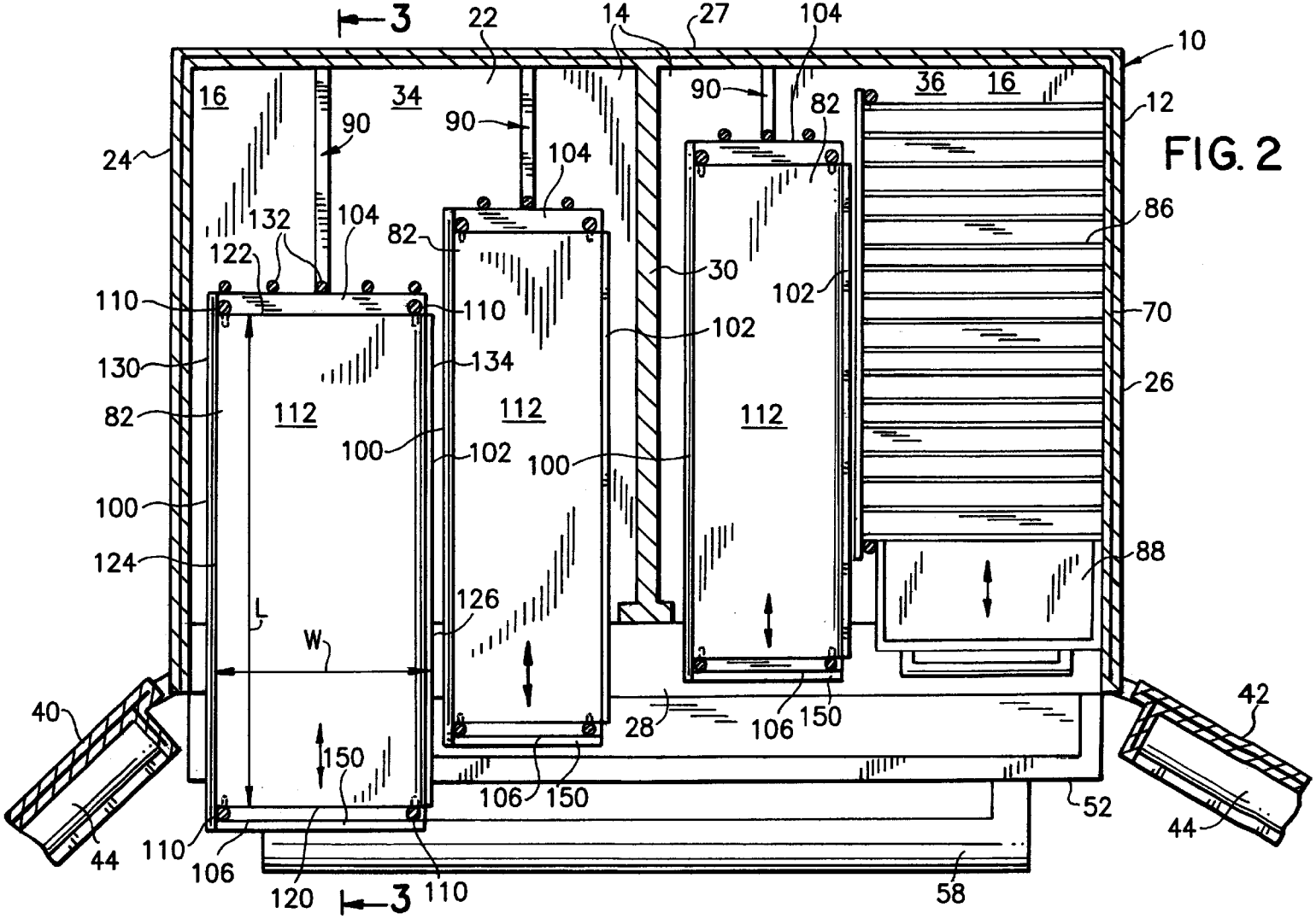
FIG. 2 is a lateral cross-sectional view taken along line 2—2 of FIG. 1.
Figure 3:
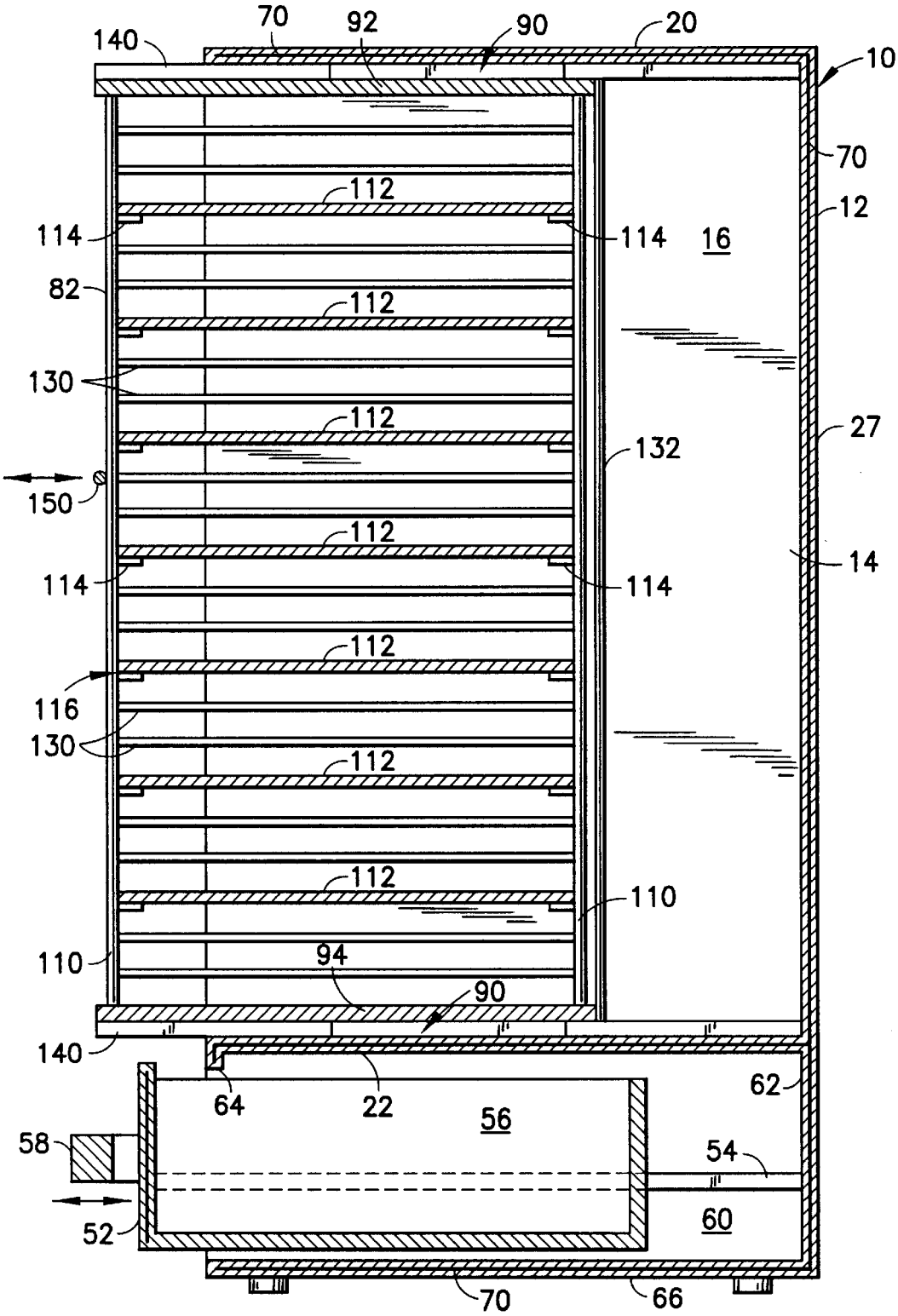
FIG. 3 is an altitudinal cross-sectional view taken along line 3—3 of FIG. 2.

Referring now to the drawing, and especially to FIGS. 1 through 3 thereof, a refrigerator 10 is seen to include an insulated cabinet 12 having a cooled compartment 14 with an interior 16 bounded by a top wall 20, an altitudinally opposite bottom wall 22, a left side wall 24, a right side wall 26 laterally opposite the left side wall 24, a rear wall 27 and a front opening 28 longitudinally opposite the rear wall 27. In the illustrated embodiment, the cooled compartment 14 is shown divided by a central partition 30 into two sub-compartments in the form of a 20 left sub-compartment 34 and a right sub-compartment 36; however, the division into sub-compartments merely is illustrative of a commonly available conventional refrigerator configuration and is not an essential feature of the present invention. A left door 40 selectively opens and closes access to the left sub-compartment 34, and a right door 42 selectively opens and closes access to the right sub-compartment 36. Both doors 40 and 42 carry internal shelves 44, as is known in current refrigerator configurations. A freezer compartment 50 is located below the cooled compartment 14 and includes a freezer drawer 52 mounted upon drawer slides 54 for selective opening and closing by sliding out of and into a freezer interior 56, with the assistance of a drawer handle 58. The freezer interior 56 is bounded by side walls 60, a longitudinally opposite front opening 64, a rear wall 62 and a bottom wall 66, as well as the bottom wall 22 of the cooled compartment 14. All of the walls surrounding both the cooled interior 16 and the freezer interior 56 include thermal insulation 70, as is conventional in refrigerator construction.

The present invention provides a shelving system 80 having a plurality of shelf units 82 mounted within the interior 16 of the refrigerator 10 for enabling the storage of items, shown by way of example at 83, within the interior 16 of the cooling compartment 14. In the illustrated embodiment, the left sub-compartment 34 is shown to have two shelf units 82, while the right sub-compartment incorporates one shelf unit 82 in combination with a more conventional shelving arrangement 84 in which laterally extending essentially fixed shelves 86 are stacked above a storage drawer 88. The combination allows for the storage of extra large items, such as items 87, on shelves 86 and certain loose items, such as meats and vegetables, as illustrated at 89, in drawer 88, in a conventional manner.

Shelf units 82 are constructed in accordance with the present invention, each shelf unit 82 being mounted within the interior 16 of the refrigerator 10 by suspension assemblies 90 placed along a unit top 92 and a unit bottom 94, the suspension assemblies 90 being located and secured between the top wall 20 and a corresponding unit top 92, and between the bottom wall 22 and a corresponding unit bottom 94. In the illustrated embodiment, two shelf units 82 are located in side-by-side arrangement in the left sub-compartment 34, essentially filling the volume of the interior of the left sub-compartment 34, while one shelf unit 82 essentially fills the space in the right sub-compartment 36, adjacent the conventional shelving arrangement 84.

As best seen in FIGS. 2 and 3, as well as in FIG. 1, each shelf unit 82 includes laterally opposite sides 100 and 102 aligned generally with the laterally opposite side walls 24 and 26 of the interior 16 of the refrigerator 10, a rear 104 aligned generally with the rear wall 27, and a longitudinally opposite front 106 adjacent the front opening 28. Columns 110 extend altitudinally between the unit top 92 and the unit bottom 94 and carry a plurality of shelves 112 supported on the columns 110 by support pins 114 placed at selected altitudinal positions along the columns 110 for locating the shelves 112 at selected locations in an array 116 of spaced apart shelves 112. In this manner, the altitudinal positions of shelves 112 can be adjusted to accommodate items of various height.

Each shelf 112 extends longitudinally between the rear 104 and the front 106 of shelf unit 82 and includes a length L extending longitudinally between ends 120 and 122, corresponding generally to the longitudinal length of the shelf unit 82, and a relatively narrow width W extending laterally between edges 124 and 126, corresponding generally to the relatively narrow lateral width of the shelf unit 82. A plurality of bars 130 are affixed to columns 110 at the side 100 of each shelf unit 82 and extend longitudinally along the shelf unit 82, adjacent the edges 124 of shelves 112, to establish a barrier for confining stored items 83 to placement on a shelf 112. The bars 130 are spaced apart from one another to at least partially open the barrier for facilitating the circulation of air throughout the cooled compartment 14 in order to maintain cooling efficiency. A further barrier is established at the rear 104 of each shelf unit 82 by altitudinally extending bars 132. Optionally, further bars (not shown) may be affixed at the front 106 of each shelf unit 82, in a manner similar to bars 130 or 132, to establish a still further barrier for confining stored items 83 to the shelves 112. A retention lip 134 extends along the edge 126 of each shelf 112 to assist in retaining items 83 on the shelf 112, while allowing access for selective placement and removal of items 83. The longitudinal length of shelf unit 82 matches the depth of the interior 16 of the cooled compartment 14, between the rear wall 27 and the front opening 28; however, shelf units 82 may be constructed in various widths to accommodate items of different widths while still essentially filling the volume available in the cooled compartment 14.

Figure 4:
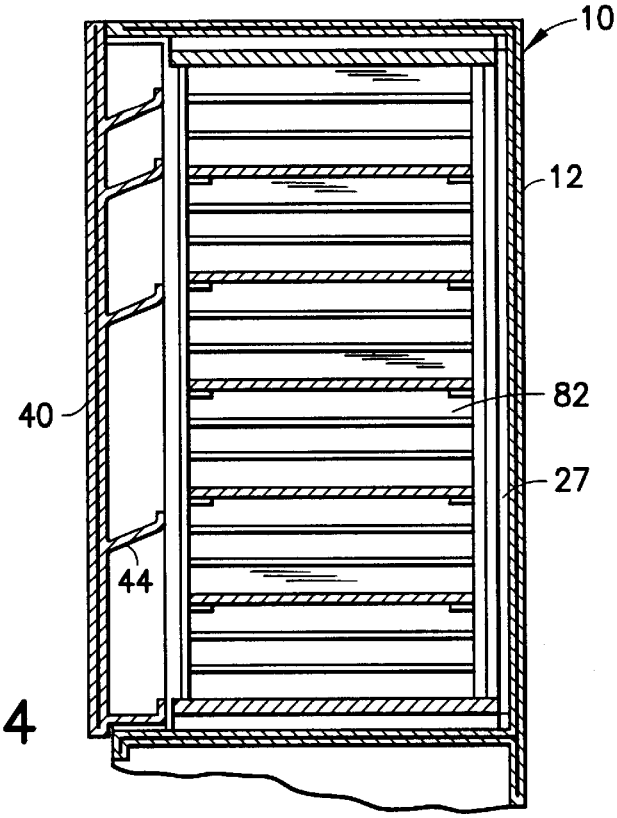
FIG. 4 is a fragmentary cross-sectional view similar to FIG. 3, but reduced in size and showing the component parts in another position of operation.
Figure 5:
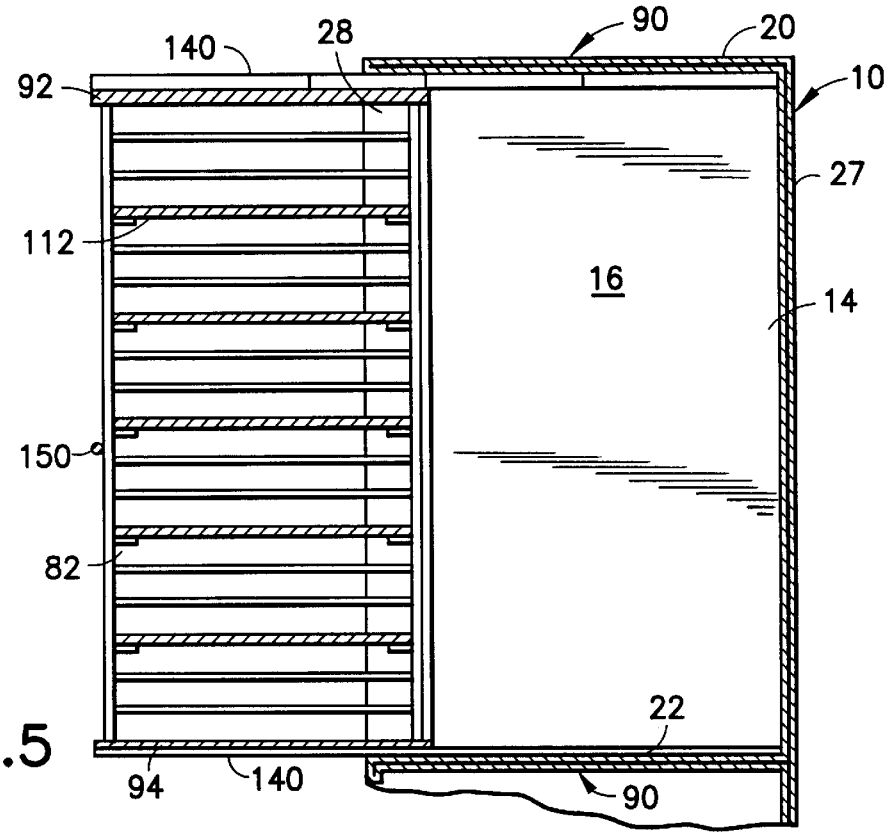
FIG. 5 is a fragmentary cross-sectional view similar to FIG. 4, and showing the component parts in still another position of operation.

Turning now to FIGS. 4 and 5, as well as to FIGS. 1, 2 and 3, the suspension assemblies 90 are shown in the form of full suspension devices 140 which enable each shelf unit 82 to be selectively moved along longitudinal forward and backward directions between a fully retracted position, as illustrated in FIG. 4, and a fully extended position, as illustrated in FIG. 5. In the fully retracted position, each shelf unit 82 is located fully within the interior 16 of the cooled compartment 14, and the refrigerator doors 40 and 42 can be closed. In the fully extended position, all of the shelves 112 of a shelf unit 82 are exposed along essentially the entire length L of the shelves and are thereby rendered accessible simultaneously, along directions extending laterally from edge 126 toward edge 124, for ease of placement of items to be stored and for ease of reaching items already stored on the shelves 112, for facilitating retrieval. Because the shelves 112 are relatively narrow, laterally from edge 124 to edge 126, as opposed to the depth of conventional shelves, such as shelves 86, maximum use is made of the full volume of the cooled compartment 14 for the storage of items 83, with maximum accessibility to the stored items 83 for retrieval. The placement of full suspension devices 140 at both the top 92 and the bottom 94 of each shelf unit 82 allows simplicity of construction with maximum effectiveness in providing the desired fully retracted and fully extended positions, while providing a rugged construction for long term reliability. Movement of each shelf unit 82 from one to the other of the retracted and extended positions is facilitated by the use of a handle 150 placed at the front of each shelf unit 82.

It will be seen that the present invention attains all of the objects and advantages summarized above, namely: Provides a refrigerator shelving system which enables increased ease of access to items stored throughout the entire interior of a refrigerator; essentially eliminates ordinarily hard-to-reach areas located at the rear of a refrigerator interior; makes effective storage use of the full volume of a refrigerator interior; increases the availability of readily usable storage space within the interior of a refrigerator; allows increased ease in locating and accessing items stored in a refrigerator; provides a refrigerator shelving system having increased effectiveness in storage and use, with a relatively simple and economically fabricated construction; provides an easily modified arrangement which enables increased versatility for the storage of a wide variety of items in a refrigerator; avoids excessive residence time of stored items, and consequent spoilage, by affording ease of access to items stored at virtually any location within a refrigerator; provides an ergonomic arrangement which encourages effective utilization of available storage capacity of a refrigerator; enables increased ease in viewing and identifying items stored throughout the interior of a refrigerator; provides a shelving system compatible with conventional refrigerator construction for ease of incorporation into currently available refrigerator configurations; provides a relatively rugged construction capable of effective operation over a long service life.

It is to be understood that the above detailed description of a preferred embodiment of the invention is provided by way of example only. Various details of design and construction may be modified without departing from the true spirit and scope of the invention, as set forth in the appended claims.

What is claimed is:

1. An improvement in a refrigerator shelving system within a refrigerator having a cooled interior bounded by a top wall, an altitudinally opposite bottom wall, laterally opposite side walls, a rear wall and a longitudinally opposite front opening, the improvement comprising:

a plurality of shelf units, each shelf unit including laterally opposite sides aligned generally with the laterally opposite side walls of the interior of the refrigerator, a rear adjacent the rear wall, a longitudinally opposite front adjacent the front wall, and shelves, each shelf having a longitudinal length extending between the rear and the front of a corresponding shelf unit, and a lateral width, extending between the laterally opposite sides of the corresponding shelf unit, the shelves being arranged in an array of altitudinally spaced apart shelves with access to each shelf available through at least one side of the corresponding shelf unit, in lateral directions;

barriers along at least the other of the opposite sides of each shelf unit, the barriers being sufficient to confine stored items to placement on the shelves of the shelf unit while rendering the other of the opposite sides sufficiently open to facilitate the circulation of air throughout the cooled interior and viewing of the stored items through the other of the opposite sides; and at least one suspension assembly mounting each shelf unit within the interior of the refrigerator for selective movement along longitudinal forward and backward directions between a retracted position, wherein the shelf unit is located fully within the interior of the refrigerator, between the front opening and the rear wall, and an extended position, wherein the shelf unit is extended longitudinally forward to expose the shelves for simultaneous access to all of the shelves of the shelf unit in lateral directions through at least one of the opposite sides of the shelf unit;

the front of each shelf unit, as well as the barriers, being sufficiently open to enable viewing of the stored items throughout the interior of the refrigerator when the shelf units are in the retracted position so as to avoid the necessity to move shelf units to the extended position in order to locate a selected stored item.

2. The improvement of claim 1 wherein the shelf units are juxtaposed in side-by-side arrangement within the interior of the refrigerator.

3. The improvement of claim 1 wherein each suspension assembly comprises a full suspension device enabling a corresponding shelf unit to be located essentially fully outside the interior of the refrigerator, thereby exposing essentially the entire length of the shelves of the shelf unit for access in lateral directions to the full length of each shelf of the shelf unit when the shelf unit is in the extended position.

4. The improvement of claim 3 including a partially open barrier along the other of the opposite sides of each shelf unit for confining stored items to placement on the shelves of the shelf unit while facilitating the circulation of air throughout the cooled interior.

5. The improvement of claim 4 wherein each shelf unit includes a top adjacent the top wall and a bottom adjacent the bottom wall, and each suspension assembly is placed at one of a first location and a second location, the first location being between the top of the shelf unit and the top wall and the second location being between the bottom of the shelf unit and the bottom wall.

6. The improvement of claim 1 wherein each shelf unit includes a top adjacent the top wall and a bottom adjacent the bottom wall, and a suspension assembly is placed at each of a first location and a second location, the first location being between the top of the shelf unit and the top wall and the second location being between the bottom of the shelf unit and the bottom wall.

7. The improvement of claim 6 wherein the shelf units are juxtaposed in side-by-side arrangement within the interior of the refrigerator.

8. The improvement of claim 6 wherein each suspension assembly comprises a full suspension device enabling a corresponding shelf unit to be located essentially fully outside the interior of the refrigerator, thereby exposing essentially the entire length of the shelves of the shelf unit for access in lateral directions to the full length of each shelf of the shelf unit when the shelf unit is in the extended position.

9. The improvement of claim 8 wherein the shelf units are juxtaposed in side-by-side arrangement within the interior of the refrigerator.

10. The improvement of claim 9 including a partially open barrier along the other of the opposite sides of each shelf unit for confining stored items to placement on the shelves of the shelf unit while facilitating the circulation of air throughout the cooled interior.

* * * * *